United States Patent [19]

Kawakami et al.

[11] Patent Number: 4,985,212

[45] Date of Patent: Jan. 15, 1991

[54] SUPPORT APPARATUS FOR A CERAMIC HONEYCOMB ELEMENT

[75] Inventors: Takashi Kawakami, Yokohama; Yasuhiro Kashima, Kawasaki, both of Japan

[73] Assignee: Kabushiki Kaisha Toshiba, Kawasaki, Japan

[21] Appl. No.: 470,434

[22] Filed: Jan. 24, 1990

Related U.S. Application Data

[63] Continuation of Ser. No. 250,243, Sep. 28, 1988, abandoned.

[30] Foreign Application Priority Data

Sep. 29, 1987 [JP] Japan ..... 62-245428
Mar. 28, 1988 [JP] Japan ..... 63-73810

[51] Int. Cl.[5] ..... B01D 53/36

[52] U.S. Cl. ..... 422/179; 422/180; 422/221; 422/222; 29/890

[58] Field of Search ..... 422/171, 176, 177, 179, 422/180, 221, 222; 60/299, 301; 423/213.2, 213.7; 29/157 R, 890

[56] References Cited

U.S. PATENT DOCUMENTS 4,007,539 2/1977 Nishio ..... 29/455 R
4,324,701 4/1982 Honda et al. ..... 252/477 R
4,413,470 11/1983 Scheihing ..... 60/39.32
4,698,213 10/1987 Shimozi et al. ..... 422/179

FOREIGN PATENT DOCUMENTS 58-175720 10/1983 Japan .
58-179730 10/1983 Japan .
59-13830 1/1984 Japan .

OTHER PUBLICATIONS

SAE Technical Paper Series 850130, "Long-Term Durability of Ceramic Honeycombs for Automotive Emissions Control." by Suresh, T. Gulati, Feb. 1985.

*Primary Examiner*—Robert J. Warden
*Assistant Examiner*—D. John Griffith, Jr.
*Attorney, Agent, or Firm*—Oblon, Spivak, McClelland, Maier & Neustadt

[57] ABSTRACT

Disclosed is an apparatus for supporting a ceramic honeycomb element which is anisotropic in modulus of elasticity and in strength. The support apparatus comprises a shock absorber which is interposed between a casing and the honeycomb element so that a force of pressure acts on the honeycomb element in high-strength directions of the honeycomb structure thereof.

3 Claims, 6 Drawing Sheets

SUPPORT APPARATUS FOR A CERAMIC HONEYCOMB ELEMENT

This application is a continuation of application Ser. No. 250,243, filed on Sept. 28, 1988, now abandoned.

BACKGROUND OF THE INVENTION

1. Field of the Invention

The present invention relates to an automotive exhaust system or a catalytic-reactor type apparatus and, more particularly, to an apparatus for supporting a ceramic honeycomb element, used as a catalyst carrier, on a casing in the above combustion apparatus.

2. Description of the Related Art

A number of combustion apparatuses or reactors, such as gasoline-powered automobile engines, gas turbines combustors, etc., employ the catalytic reaction system, in which a ceramic element having a honeycomb cell structure acts as a catalyst carrier. More precisely, this honeycomb cell structure is covered with a catalyst which contains a precious metal. It is inserted in a tubular support which in turn is inserted in a tubular casing. The honeycomb cell structure is made of ceramics such as cordierite, whereas the casing is made of metal, such as hastelloy or SUS-316, and the support is a ceramic fiber mat or the like. The support is required for the following reason.

Since the honeycomb cell structure is surrounded by the casing, gas can flow through the cells. As gas flows through the cells of the structure, the catalyst carrier and the casing are heated to temperatures as high as 700° C. in the case of an automobile engine, and as high as 1,000° C. in the case of a gas turbine combustor. The casing, which is made of metal, tends to expand when heated to high temperature. In contrast, the honeycomb element, which is made of ceramics, hardly changes in size, since ceramics has an coefficient of linear expansion as low as about $1\times10^{-6}$. Although made of ceramic fibers, the support expands when heated. Hence, the support, as a whole, is soft and elastic enough to function as a shock absorber and also as a holder for the honeycomb cell structure. The support can absorb the compressive force of the expanding casing, while it is holding the honeycomb cell structure in place. Without the support, the structure, which is brittle, could be broken when the casing is heated temperatures as high as 700° C. to 1,000° C. and applies a compressive force to the structure. This is why the support is indispensable.

FIG. 9 is a cross-sectional view showing a prior art support which is a shock-aborbing mat 23 formed of ceramic fibers and wound around cylindrical honeycomb element 14. As can be seen in this figure, most of the cells of honeycomb element 14 are square in shape. Since most cells are square, element 14 is anisotropic in regard to its modulus of elasticity and its strength. More specifically, element 14 is about only ten times less strong against a force (especially a compressive force) acting on it in the direction given by $\theta=45°$ (FIG. 10) than to a force acting on it in the direction given by $\theta=0°$. Thus, if a compressive force were to act on it in the direction given by $\theta=45°$, honeycomb element 14 would break though it is strong enough against greater forces acting in other directions.

When shock-absorbing member 23 receives a compressive force, member 23, which is made of ceramic fibers, distributes this force uniformly on the circumference of honeycomb element 14. Thus, the force acts on element 14 equally in all directions. Consequently, honeycomb element 14 is liable to break from the force applied in the direction given by $\theta=45°$ unless this force is extremely small. In other words, in the conventional honeycomb element support apparatus, the ceramic honeycomb element would be broken by a force smaller than the force corresponding to its average strength.

SUMMARY OF THE INVENTION

In consideration of the above, it is an object of the present invention to provide an improved support apparatus, such as holders, for supporting an anisotropic ceramic honeycomb element in a manner such that the honeycomb element cannot be broken by a force which is less than that corresponding to its average strength.

In order to achieve the above object, a support apparatus according to the present invention comprises a support structure situated beside a ceramic element having an anisotropic honeycomb structure, and a shock absorber located between the support structure and the ceramic element and adapted to laterally press the ceramic element, thereby producing a supporting force to support the ceramic element, the supporting force from the shock absorber acting on the ceramic element in those directions where the honeycomb structure is high in strength.

This and other objects and advantages of the present invention will become more apparent from the description which follows, and from the drawings.

DETAILED DESCRIPTION OF THE PREFERRED EMBODIMENTS

Figure 1:
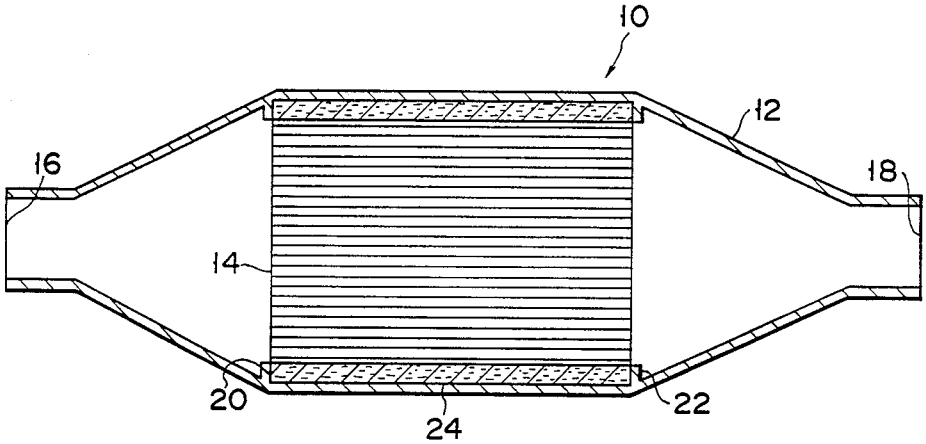
FIGS. 1 to 3B show a first embodiment of the present invention, FIG. 1 being a schematic longitudinal sectional view of a catalytic reactor incorporating a ceramic honeycomb element, FIG. 2 being a cross-sectional view of this catalytic reactor, for illustrating a support apparatus, and FIGS. 3A and 3B being schematic perspective views illustrating a method of manufacturing a shock absorber.

Preferred embodiments of the present invention will now be described in detail with reference to the accompanying drawings. FIG. 1 shows catalytic reactor 10 in which a ceramic element having a honeycomb construction is used as a catalyst carrier. Catalytic reactor 10 comprises cylindrical ceramic honeycomb element 14 and metallic casing or can 12 enclosing the same. Can 12 is formed of a suitable material, such as hastelloy, SUS-304, or SUS-316. The choice of material depends on the type of gas, the maximum temperature and the like. Honeycomb element 14 is formed by extruding a ceramic material such as cordierite. Can 12 has inlet and outlet ports 16 and 18. Gas introduced through inlet port 16 flows through individual cells of honeycomb element 14, and goes out through outlet port 18.

Figure 9:
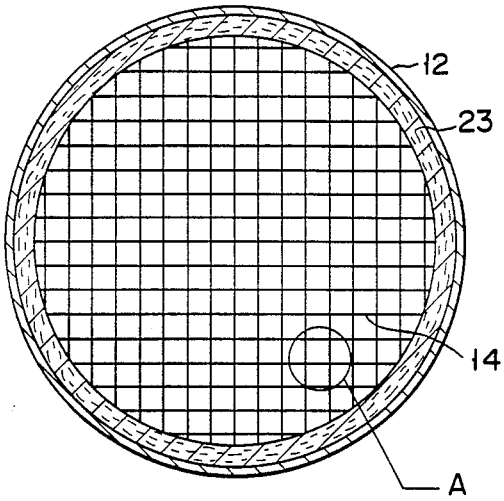
FIG. 9 (PRIOR ART)
FIG. 9 is a cross-sectional view of catalytic reactor, similar to FIG. 2, for illustrating a prior art support apparatus.
Figure 10:
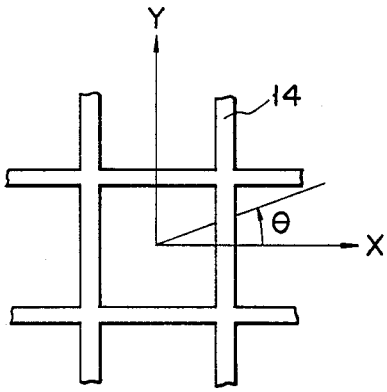
FIG. 10 (PRIOR ART)
FIG. 10 is an enlarged view showing portion A of FIG. 9 in detail.

Ceramic honeycomb element 14, like the one shown in FIG. 9, has square cells. Usually, the distance between each two adjacent cells is about 0.7 to 2.0 mm, the wall thickness of element 14 is about 0.01 to 0.3 mm, and the cell density (per unit area) is about 200 to 400 cells/in$^2$. The cells of honeycomb element 14 may have any shapes other than the square configuration. In consideration of tooling costs for extrusion molding or the like, however, the cells are generally square in shape.

Ceramic honeycomb element 14 is supported on can 12 by means of ceramic fiber mat or wire mesh 24 for use as a shock absorber. Mat 24, which is formed of cottony ceramic fibers, tends to expand when heated. "Interam" (trademark of 3M Company) or "Nextel" (trademark of 3M Company) may be used as the ceramic fiber mat. Having a width substantially equal to the length of honeycomb element 14, fiber mat 24 is interposed between element 14 and can 12 so as to be wound around element 14, and is set by proper heating. The set fiber mat presses the outer periphery of honeycomb element 14, thereby fixing it against a drag caused by the gas flow. Abutting pieces 20 and 22 protrude from the inner periphery of can 12, whereby fiber mat 24 is prevented from being longitudinally dislocated, with respect to can 12, by the drag from the gas flow.

Figure 2:
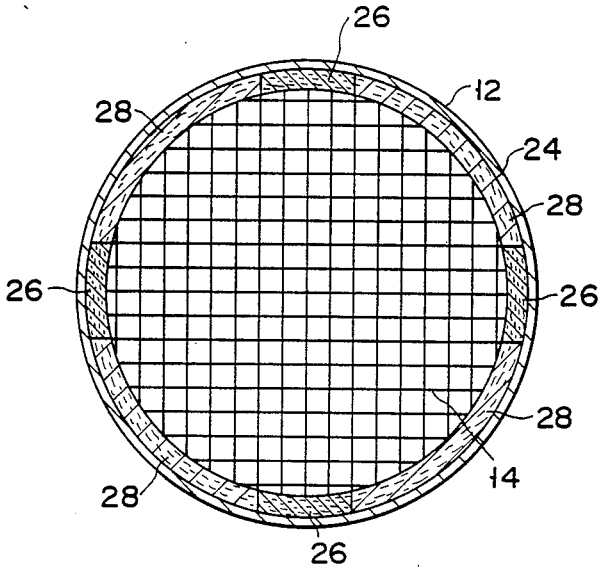

As shown in FIG. 2, ceramic fiber mat 24 is constructed so that the fiber packing density (per unit volume) is higher at those portions corresponding to high-strength directions of ceramic honeycomb element 14, given by $\theta=0°$, 90°, 180°, or 270°, than at the other portions, especially at those portions corresponding to low-strength directions of element 14, given by $\theta=45°$, 135°, 225°, or 315°. Thus, mat 24 is composed of high-density portions 26 and low-density portions 28 which, arranged alternately, expand at different rates when heated.

Figure 3A:
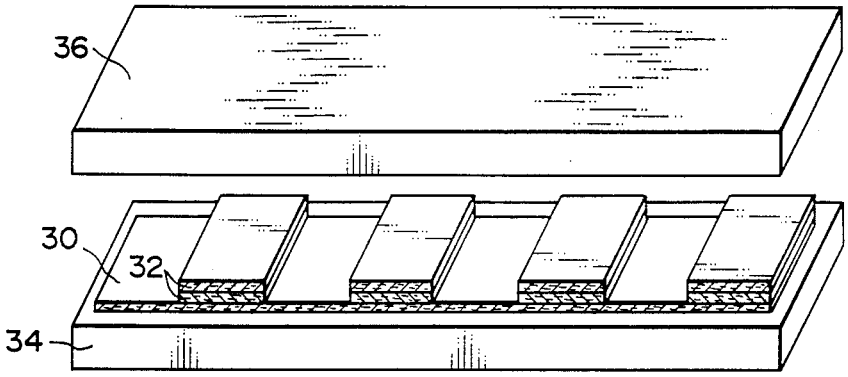
Figure 3B:
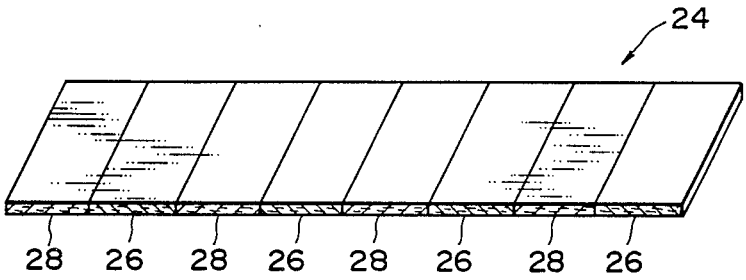

Ceramic fiber mat 24 can be manufactured as follows. A belt-shaped mat structure of ceramic fibers is prepared having width substantially equal to the length of honeycomb element 14. This mat structure is cut into several pieces, including mat 30, which has a length corresponding to the length of the outer periphery of honeycomb element 14, and 8 stacking mats 32 which have a length bearing a predetermined ratio to the peripheral length of element 14. Pairs of cut stacking mats 32 are placed on mat 30 at four positions, which correspond individually to the aforesaid high-strength directions of the honeycomb element given by $\theta=0°$, 90°, 180°, or 270°. FIG. 3A shows the way mats 32 are arranged on mat 30. Mat 30, with mats 32 thereon, is disposed between compression-molding dies 34 and 36, to be compressed by means of a press. Thus, ceramic fiber mat 24 is obtained which is composed of high- and low-density portions 26 and 28 arranged alternately.

When the gas is circulated through catalytic reactor 10, ceramic fiber mat 24 is expanded by heat, thereby increasing its force of pressure on honeycomb element 14. In this case, the high-density portions of mat 24 expand at a higher rate, and therefore, press the outer peripheral surface of element 14 with a relatively great force. Since high-density portions 26 of mat 24 are situated in those positions corresponding to the high-strength directions of honeycomb element 14, the force of pressure, used to support element 14, acts mainly in the high-strength directions of element 14. On the other hand, a relatively small force of pressure acts in the low-strength directions of honeycomb element 14, corresponding to the packing density. Low-density portions 28 primarily serve as sealing means for the gas flow. Thus, according to this supporting holder, the ceramic element with the honeycomb structure, which is anisotropic in strength, can be supported without being broken by a force smaller than the force corresponding to its average strength.

Figure 4:
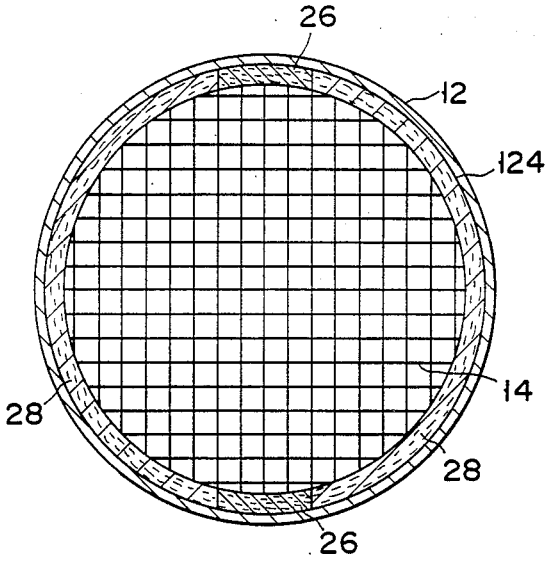
FIG. 4 is a cross-sectional view, similar to FIG. 2, showing a second embodiment of the support apparatus of the invention.

FIG. 4 shows a second embodiment of the support apparatus for the ceramic honeycomb element according to the present invention. In this embodiment, fiber mat 124 is constructed so that high-density portions 26 are situated individually in two opposite positions ($\theta=0°$ or 180°), out of the positions corresponding to the high-strength directions of honeycomb element 14. As regards other points, the second embodiment is constructed substantially in the same manner as the first embodiment. With such an arrangement, the second embodiment can produce the same effect of the first embodiment.

Figure 5:
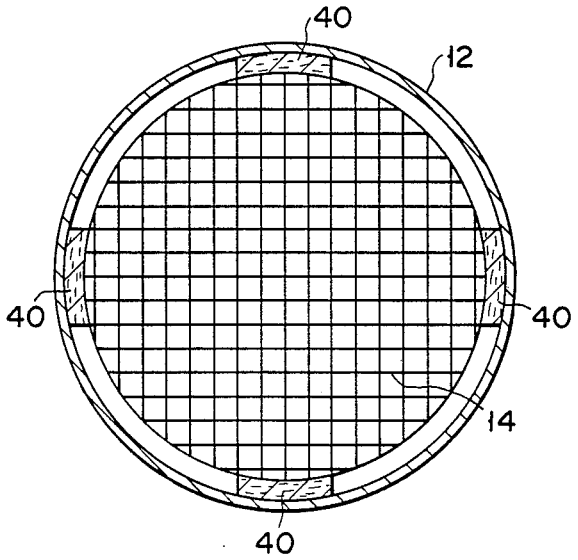
FIG. 5 is a cross-sectional view, similar to FIG. 2, showing a third embodiment of the support apparatus of the invention.
Figure 6:
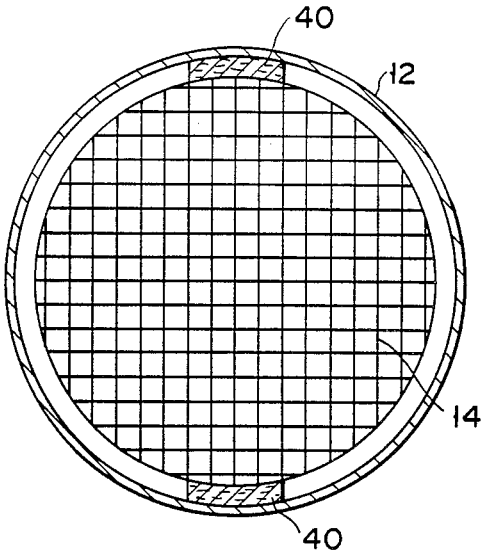
FIG. 6 is a cross-sectional view, similar to FIG. 2, showing a fourth embodiment of the support apparatus of the invention.

FIG. 5 shows a third embodiment of the support apparatus according to the present invention. In this embodiment, four ceramic fiber mats 40, for use as shock absorbers, are situated individually in the four positions corresponding to the high-strength directions of honeycomb element 14 given by $\theta=0°$, 90°, 180°, or 270°. In other positions than those specific positions, open spaces are defined between casing 12 and honeycomb element 14. The four fiber mats have the same packing density, and support element 14 by pressing it equally in the high-strength directions thereof. FIG. 6 shows a fourth embodiment of the support apparatus according to the present invention. In this embodiment, ceramic fiber mats 40 as shock absorbers are situated individually in only two opposite positions corresponding to the directions given by $\theta=0°$ or 180°. Also in the embodiment shown in FIGS.. 5 and 6, as in the first embodiment, a ceramic element with a honeycomb structure, which is anisotropic in strength, can be supported without being broken by a force smaller than the force corresponding to its average strength.

Figure 7:
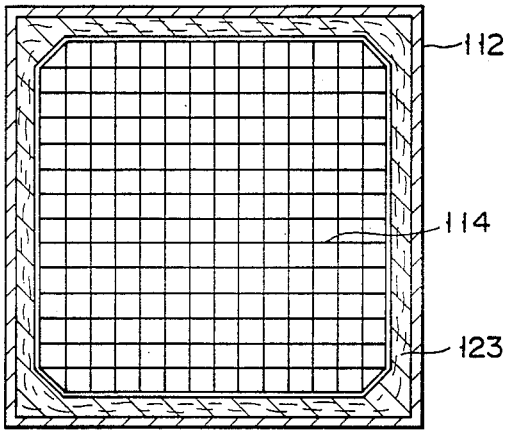
FIG. 7 is a cross-sectional view showing a fifth embodiment of the support apparatus of the invention.
Figure 8:
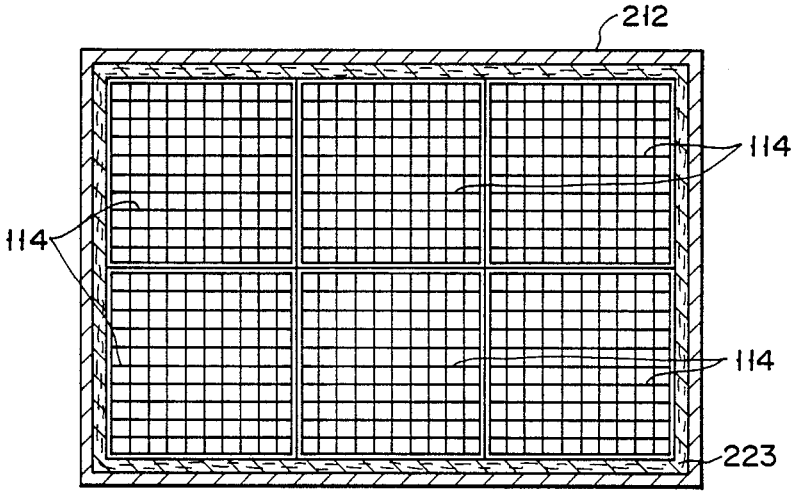
FIG. 8 is a cross-sectional view of a ceramic honeycomb element assembly used in a passage of a relatively wide cross section incorporating the support apparatus shown in FIG. 7.

FIGS. 7 and 8 show a fifth embodiment of the support apparatus according to the present invention. In this embodiment, as seen from FIG. 7, honeycomb element 114 is rectangular in shape, and correspondingly, casing 112 is also rectangular. In this case, those portions of honeycomb element 114 corresponding to low-strength directions thereof are corner portions. Therefore, ceramic fiber mat 123, for use as a shock absorber, is located over the whole outer periphery of honeycomb element 114. This embodiment is particularly suited for a wide ceramic honeycomb element, as shown in FIG. 8. A desired number of rectangular honeycomb elements 114, shown in FIG. 7, are joined together to form a flat plate. The resulting plate is enclosed in casing 212 to complete a honeycomb member having a desired wide passage area. Also in this case, ceramic fiber mat 223 is located over the whole outer periphery of the set of honeycomb elements 114 collected in the form of the flat plate.

It is to be understood that the present invention is not limited to the embodiments described above, and that various changes and modifications may be effected therein by one skilled in the art without departing from the scope or spirit of the invention. The shock absorber is not limited to the ceramic fiber mats or wire meshes, and may be formed of any other materials, provided they tend to expand when heated, and can absorb a shock on the ceramic element. In the embodiments described above, moreover, the cells of the ceramic honeycomb element are square in shape. The support apparatus according to the present invention may, however, be used to support an anisotropic honeycomb element with cells of any other suitable shape.

What is claimed is:

1. A reactor comprising:

a hollow cylindrical ceramic honeycomb element containing a catalyst, having a number of rectangular holes defined by a pair of parallel wall groups intersecting each other perpendicularly and extending in the axis of the ceramic element;

a casing made of material having a higher thermal expansion coefficient than said ceramic element, and having a circular cross section, and surrounding said ceramic element, thus defining an annular space between the outer periphery of said ceramic element and the inner periphery of the casing; and a ring-shaped filling member filled in the annular space so as to seal the annular space, having a uniform thickness and made of a material the thermal-expansion coefficient and elasticity of which increase in proportion to the density of the material, said filling member including, at least two high-density portions located at each of two regions which are diametrically opposed with respect to the axis of the ceramic element and at which at least one of the wall groups of said ceramic element extend substantially normal to the filling member, and at least two low-density portions located at each of two regions other than the regions at which the high-density portions are located;

whereby said high-density portions have a density higher than that of said low-density portions such that when said ceramic element is heated, the high-density portions expand more than the low-density portions and apply greater force to said ceramic element, such that the high-density portions firmly hold said ceramic element and seal the annular space, while the low-density portions seal the annular space in a manner that the low-density portions apply substantially less force to said ceramic element than the high-density portions.

2. The apparatus according to claim 1, wherein said filling member is a mat made of ceramic fibers.

3. A method of manufacturing an apparatus for supporting a hollow cylindrical ceramic honeycomb element having a circular cross section and having a number of rectangular holes defined by a pair of parallel wall groups intersecting each other perpendicularly and extending in the axis of the ceramic element, said method comprising the steps of:

preparing a sheet member having a length equal to the circumference of the ceramic element and made of a material the thermal expansion coefficient and elasticity of which increase in proportion to the density at which it fills a limited space;

arranging a plurality of filling members on the sheet member, spaced apart at predetermined intervals in the lengthwise direction of the sheet member, each filling member formed of a predetermined number of laminated layers made of the same material as the sheet member;

compressing the filling member and the sheet member, thus forming a filling sheet which has a thickness uniform in the lengthwise direction of the sheet member and has high-density portions and low-density portions;

winding the filling sheet around the ceramic element, with at least one of the wall groups of the ceramic element extending substantially normal to the high-density portions of the filling sheet;

inserting the ceramic element with the filling members wound around the ceramic element, into a hollow cylindrical case made of metal so as to fill a space between the casing and the ceramic element and seal it; and wherein when said ceramic element is heated, the high-density portions expand more than the low-density portions and apply greater force to said ceramic element, such that the high-density portions firmly hold said ceramic element and seal the annular space, while the low-density portions seal the annular space in a manner which apply a lower force to said ceramic element than said high-density portions.

* * * * *